US008464839B2

(12) United States Patent
Ueno

(10) Patent No.: US 8,464,839 B2
(45) Date of Patent: Jun. 18, 2013

(54) CAR DOOR APPARATUS FOR AN ELEVATOR

(75) Inventor: Tatsuhisa Ueno, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 358 days.

(21) Appl. No.: 13/054,848

(22) PCT Filed: Sep. 25, 2008

(86) PCT No.: PCT/JP2008/067278

§ 371 (c)(1),
(2), (4) Date: Jan. 19, 2011

(87) PCT Pub. No.: WO2010/035322

PCT Pub. Date: Apr. 1, 2010

(65) Prior Publication Data

US 2011/0155512 A1 Jun. 30, 2011

(51) Int. Cl.
*B66B 13/06* (2006.01)

(52) U.S. Cl.
USPC ..... 187/334; 187/340

(58) Field of Classification Search
USPC ..... 187/277, 316, 317, 319–325, 330–335, 187/340, 341; 49/31, 73.1, 77.1, 89.193–96, 49/116, 122
See application file for complete search history.

(56) References Cited

U.S. PATENT DOCUMENTS

| | | | | |
|---|---|---|---|---|
| 2,974,751 | A * | 3/1961 | Adams | 187/319 |
| 3,738,454 | A * | 6/1973 | Atkey | 187/330 |
| 4,926,974 | A * | 5/1990 | Morris et al. | 187/319 |
| 5,377,785 | A * | 1/1995 | Pearson | 187/308 |
| 5,636,714 | A * | 6/1997 | Viola | 187/324 |
| 6,220,396 | B1 * | 4/2001 | Heath, III | 187/335 |
| 6,328,133 | B1 * | 12/2001 | Kim | 187/319 |
| 6,340,073 | B1 * | 1/2002 | Lee et al. | 187/309 |
| 6,508,332 | B2 * | 1/2003 | Fahl et al. | 187/316 |
| 6,591,946 | B2 * | 7/2003 | Lauch | 187/309 |
| 7,255,203 | B2 * | 8/2007 | Rennetaud et al. | 187/321 |
| 7,424,935 | B1 * | 9/2008 | Smith | 187/333 |

FOREIGN PATENT DOCUMENTS

| | | |
|---|---|---|
| JP | 5 186170 | 7/1993 |
| JP | 2001 302151 | 10/2001 |
| JP | 2002 187683 | 7/2002 |

OTHER PUBLICATIONS

International Search Report Issued Apr. 21, 2009 in PCT/JP08/067278 filed Sep. 25, 2008.

* cited by examiner

*Primary Examiner* — Anthony Salata

(74) *Attorney, Agent, or Firm* — Oblon, Spivak, McClelland, Maier & Neustadt, L.L.P.

(57) ABSTRACT

In a car door apparatus for an elevator, a closing-plate supporting portion is provided at a car-door front surface, the closing-plate supporting portion supporting the closing plate so that the closing plate is slidable along a direction in which the car door is opened and closed. A door-pocket cover is provided with a closing-plate engagement portion brought into engagement with the closing plate at the time of a door-closing operation to restrict displacement of the closing plate in a door-closing direction relative to the cover front-surface portion.

6 Claims, 13 Drawing Sheets

CAR DOOR APPARATUS FOR AN ELEVATOR

TECHNICAL FIELD

The present invention relates to a car door apparatus for an elevator, in which a door clutch portion to be brought into engagement with landing equipment is provided onto a car-door front surface so as to project toward a landing.

BACKGROUND ART

In a conventional car door apparatus for an elevator, a door clutch portion which is brought into engagement with landing equipment is provided onto a car-door front surface so as to project toward a landing. Moreover, a door-pocket cover is provided with a notch portion for allowing the door clutch portion to escape at the time of a door-opening operation. Further, a closing plate made of rubber for closing the notch portion when car doors are fully closed is provided to an end of each of the car doors, which is on the door-pocket side. The closing plate is guided by a guide plate provided on the inner side of the door-pocket cover to be curved (elastically deformed) at the time of the door-opening operation (for example, see Patent Document 1).

Patent Document 1: JP 2002-187683 A

DISCLOSURE OF THE INVENTION

Problems to Be Solved by the Invention

In the conventional car door apparatus for the elevator described above, the closing plate is curved or stretched each time the car-door opening/closing operation is performed. Therefore, the closing plate deteriorates with elapse of time due to flexural fatigue, and hence is not able to fully close the notch portion. As a result, sound insulating properties are degraded. On the other hand, if a rigid closing plate which cannot be curved is simply fixed to an end of the car door, which is on the door pocket side, it is necessary to enlarge the door-pocket cover outwardly so as to allow the closing plate to retract when the car doors are fully opened. As a result, a width dimension of a hoistway is disadvantageously increased.

The present invention has been made to solve the problem described above, and has an object to provide a car door apparatus for an elevator, which can prevent a width dimension of a hoistway from being increased and, at the same time, can prevent a closing plate from deteriorating due to flexural fatigue.

Means for Solving the Problems

A car door apparatus for an elevator according to the present invention includes: a car door for opening and closing a car doorway, having a car-door front surface opposed to a landing door; a door clutch portion provided on the car-door front surface so as to project toward a landing to be brought into engagement with landing equipment; a door-pocket cover including: a cover front-surface portion opposed to the car-door front surface when the car door is fully opened; and a cover side-surface portion extending from the cover front-surface portion to a side opposite to the landing, the cover front-surface portion including a notch portion for allowing the door clutch portion to escape at a time of a door-opening operation; and a closing plate for closing the notch portion when the car door is fully closed, in which: the car-door front surface is provided with a closing-plate supporting portion for supporting the closing plate so that the closing plate is slidable along a direction in which the car door is opened and closed; the door-pocket cover is provided with a closing-plate engagement portion brought into engagement with the closing plate at the time of a door-closing operation to restrict displacement of the closing plate in a door-closing direction relative to the cover front-surface portion; and the closing plate is displaced along with the car door in a door-opening direction to abut against an inner surface of the cover side-surface portion so as to slide in the door-closing direction relative to the car door at the time of the door-opening operation and is displaced along with the car door in the door-closing direction to be brought into engagement with the closing-plate engagement portion so as to slide in the door-opening direction relative to the car door at the time of the door-closing operation.

Moreover, a car door apparatus for an elevator according to the present invention includes: a car door for opening and closing a car doorway, having a car-door front surface opposed to a landing door; a door clutch portion provided on the car-door front surface so as to project toward a landing to be brought into engagement with landing equipment; a door-pocket cover including: a cover front-surface portion opposed to the car-door front surface when the car door is fully opened; and a cover side-surface portion extending from the cover front-surface portion to a side opposite to the landing, the cover front-surface portion including a notch portion for allowing the door clutch portion to escape at the time of a door-opening operation; and a closing plate for closing the notch portion when the car door is fully closed, in which: a closing-plate supporting portion for supporting the closing plate so that the closing plate is slidable along a direction in which the car door is opened and closed is provided on a surface of the cover front-surface portion, the surface being opposed to the car-door front surface; a closing-plate engagement portion to be brought into engagement with the closing plate at the time of a door-closing operation is provided to an end of the car-door front surface, the end being on a door-pocket side; and the closing plate is pressed by the door clutch portion to slide in a door-opening direction at the time of the door-opening operation and is brought into engagement with the closing-plate engagement portion to slide along with the car door in the door-closing direction at the time of the door-opening operation.

BEST MODE FOR CARRYING OUT THE INVENTION

Figure 1:
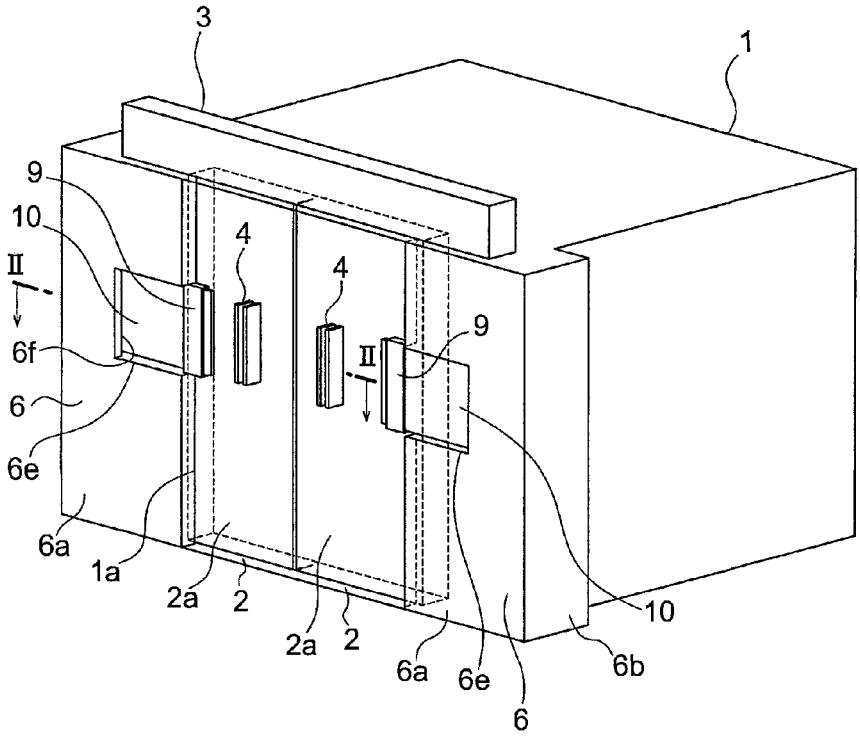
FIG. 1 is a perspective view illustrating a car of an elevator according to Embodiment 1 of the present invention.

Hereinafter, preferred embodiments of the present invention are described referring to the drawings.

Embodiment 1

Figure 2:
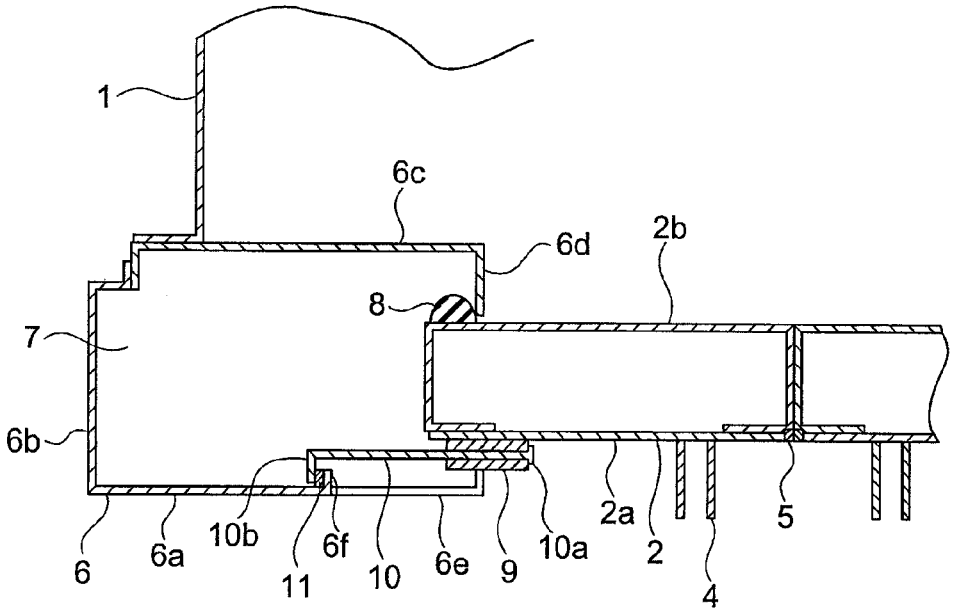
FIG. 2 is a sectional view of a car door apparatus illustrated in FIG. 1, taken along the line II-II.
Figure 3:
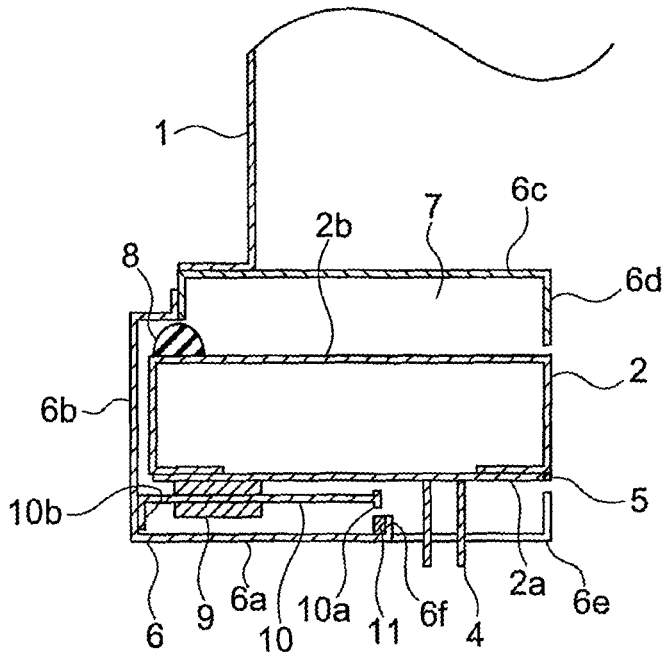
FIG. 3 is a sectional view illustrating a state of the car door apparatus illustrated in FIG. 2 when car doors are fully opened.

FIG. 1 is a perspective view illustrating a car of an elevator according to Embodiment 1 of the present invention, FIG. 2 is a sectional view of a car door apparatus illustrated in FIG. 1, taken along the line II-II, and FIG. 3 is a sectional view illustrating a state where car doors of the car door apparatus illustrated in FIG. 2 are fully opened.

In the drawings, a car doorway 1*a* is provided at the front of a car 1. The car doorway 1*a* is opened and closed by a pair of car doors 2. On the top of the car 1, a door operator 3 for driving the car doors 2 is provided. The car doors 2 are operated to be opened and closed in parallel to a width direction of the car 1 (horizontal direction of FIG. 2) by the door operator 3.

Each of the car doors 2 has a car-door front surface 2*a* opposed to a landing door (not shown) and a car-door rear surface 2*b* opposed to the interior of a cage when the car doors are fully closed. In the approximate center of each of the car-door front surfaces 2*a*, a door clutch portion 4, which is brought into engagement with landing equipment (not shown), is provided so as to project toward a landing. A door-stop rubber 5 for closing a gap between the car doors 2 when the car doors 2 are fully closed is fixed to an end of each of the car doors 2, which is on the door-stop side.

On both sides of the car doorway 1*a* of the car 1, door-pocket covers 6, each having a rectangular cross section to form a door-pocket space 7, are provided. Each of the door-pocket covers 6 includes a cover front-surface portion 6*a*, a cover side-surface portion 6*b*, a cover rear-surface portion 6*c*, and an inlet forming portion 6*d*.

An inner surface of the cover front-surface portion 6*a* is opposed to the corresponding one of the car-door front surfaces 2*a* when the car doors 2 are fully opened. The cover side-surface portions 6*b* is formed by bending an end of the cover front-surface portion 6*a*, which is on the side opposite to the car doorway 1*a*, toward the side opposite to the landing at a right angle. An inner surface of the cover rear-surface portion 6*c* is opposed to the corresponding one of the car-door rear surfaces 2*b* when the car doors 2 are fully opened. The inlet forming portion 6*d* is formed by bending an end of the cover rear-surface portion 6*c*, which is on the car doorway 1*a* side, toward the landing at a right angle.

An inlet serving as an entrance/exit for the door-pocket space 7 of the corresponding one of the car doors 2 is formed between the end of the inlet forming portion 6*d* on the landing side and the end of the cover front-surface portion 6*a* on the car doorway 1*a* side. A rectangular notch portion 6*e* for allowing the corresponding one of the door clutch portions 4 to escape at the time of a door-opening operation is provided on the cover front-surface portion 6*a*.

A sound insulating member 8 for closing a gap between the inlet forming portion 6*d* and the car-door rear surface 2*b* when the car doors 2 are fully closed is fixed to an end of the car-door rear surface 2*b*, which is on the door-pocket side.

A closing-plate supporting portion 9 is fixed onto the car-door front surface 2*a*. A flat plate-like closing plate 10 for closing the notch portion 6*e* when the car doors 2 are fully closed is supported by the closing-plate supporting portion 9. The closing plate 10 is supported by the closing-plate supporting portions 9 so as to be slidable in a direction in which the car doors 2 are opened and closed. Moreover, the closing plate 10 is displaced between a closing position (FIG. 2) at which the notch portion 6*e* is closed and a retracted position (FIG. 3) to which the closing plate retracts from the closing position in the door-opening direction with the opening/closing of the car doors 2. Further, as the closing plate 10, a metal plate is used, for example.

On an end of the closing plate 10, which is on the car doorway 1*a* side, a flange portion 10*a* for restricting the displacement of the closing plate 10 in the door-opening direction relative to the closing-plate supporting portion 9 is provided. A bent portion 10*b* obtained by bending an end of the closing plate 10, which is on the side opposite to the car doorway 1*a*, toward the landing at a right angle is provided. The bent portion 10*b* is provided continuously over the entire vertical length of the closing plate 10.

A closing-plate engagement portion 6*f* which is brought into engagement with the bent portion 10*b* so as to restrict the displacement of the closing plate 10 in the door-closing direction relative to the cover front-surface portion 6*a* at the time of the door-closing operation is provided on the cover front-surface portion 6*a*. The closing-plate engagement portion 6*f* is formed by bending an edge portion extending along the vertical direction of the notch portion 6*e* toward the side opposite to the landing at a right angle. Specifically, the closing-plate engagement portion 6*f* projects from the cover front-surface portion 6*a* toward the side opposite to the landing. Moreover, the closing-plate engagement portion 6*f* is provided continuously over the entire vertical length of the notch portion 6*e*. Further, a buffer 11 such as a rubber is provided to the closing-plate engagement portion 6*f*.

Next, an operation is described. When the car doors 2 are fully closed, the notch portion 6*e* is closed by the closing plate 10 as illustrated in FIGS. 1 and 2. At this time, the bent portion 10*b* is engaged with the closing-plate engagement portion 6*f* through an intermediation of the buffer 11. Moreover, the gap between the inlet forming portion 6*d* and the car-door rear surface 2*b* is closed by the sound insulating member 8. Further, the gap between the car doors 2 is closed by the abutment of the door-stop rubbers 5 against each other.

At the time of the door-opening operation, the closing plate 10 is displaced along with the car door 2 in the door-opening direction until the closing plate 10 abuts against an inner surface of the cover side-surface portion 6*b*. Thereafter, when the bent portion 10*b* abuts against the inner surface of the cover side-surface portion 6*b*, the displacement of the closing plate 10 in the door-opening direction is stopped and only the car door 2 is moved in the door-opening direction to the position where the car doors 2 are fully opened. At this time, the closing plate 10 is guided by the closing-plate supporting portion 9 so as to slide in the door-closing direction relative to the car door 2. Moreover, the door clutch portion 4 is displaced in the door-opening direction within the notch portion 6*e*.

At the time of a door-closing operation, the closing plate 10 is displaced along with the car door 2 in the door-closing direction until the bent portion 10*b* is engaged with the closing-plate engagement portion 6*f*. Moreover, the door clutch portion 4 is displaced in the door-closing direction within the notch portion 6*e*. Thereafter, when the bent portion 10*b* is engaged with the closing-plate engagement portion 6*f*, the displacement of the closing plate 10 in the door-closing direction is stopped and only the car door 2 is moved in the door-closing direction to the position where the car doors 2 are fully closed. At this time, the closing plate 10 is guided by the closing-plate engagement portion 6*f* so as to slide in the door-opening direction relative to the car door 2.

In the car door apparatus for the elevator as described above, the closing plate 10 is supported by the closing-plate supporting portion 9 so as to be slidable along the direction in which the car doors 2 are opened and closed, and therefore slides relative to the corresponding one of the car doors 2 when the car doors 2 are opened and closed. Thus, the closing plate 10 can be moved between the closing position and the retracted position without being curved. In addition, it is not necessary to enlarge the door-pocket cover 6 outwardly. Accordingly, the closing plate 10 can be prevented from deteriorating due to flexural fatigue, while a width dimension of a hoistway is prevented from being increased.

Moreover, while the car doors 2 are in a fully-closed state, sound insulating properties around the car doors 2 can be ensured. Noise, which is generated in the hoistway when the car 1 is raised and lowered, can be prevented from propagating to the interior of the car 1. Therefore, ride comfort is improved.

Embodiment 2

Figure 4:
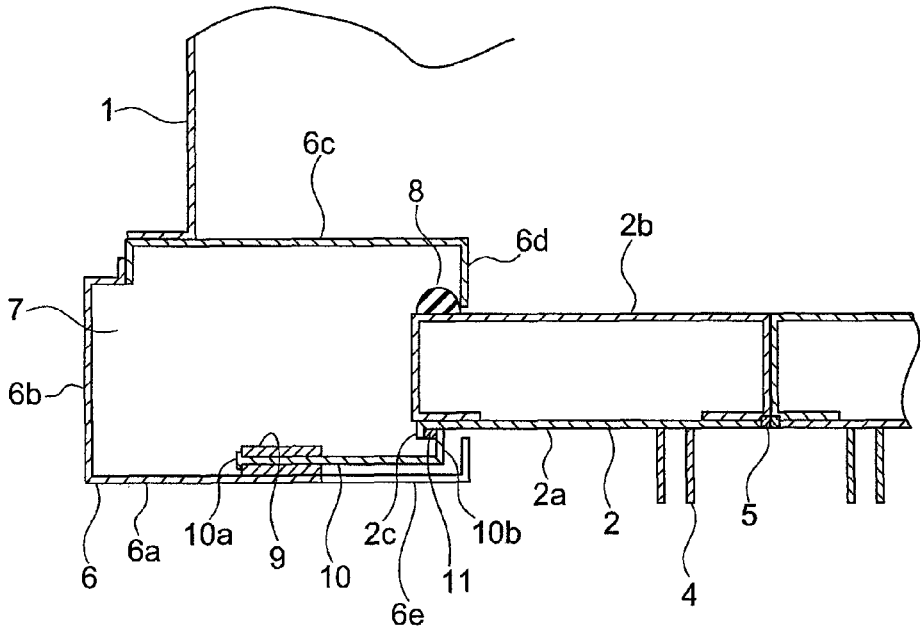
FIG. 4 is a sectional view of the car door apparatus for the elevator according to Embodiment 2 of the present invention.
Figure 5:
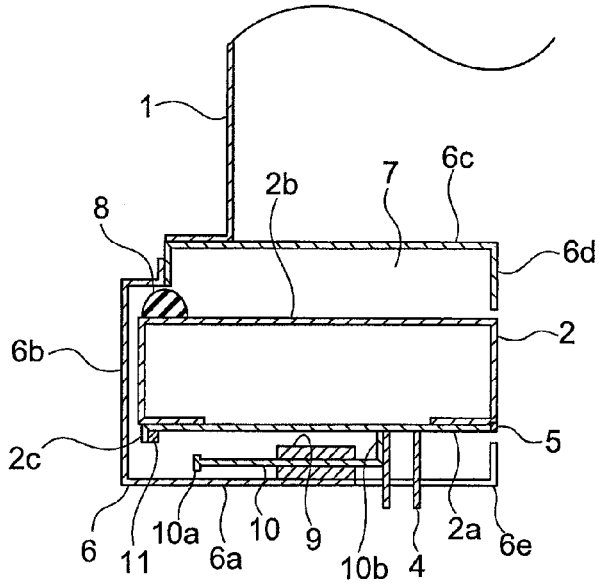
FIG. 5 is a sectional view illustrating a state of the car door apparatus illustrated in FIG. 4 when the car doors are fully opened.

Next, FIG. 4 is a sectional view of the car door apparatus for the elevator according to Embodiment 2 of the present invention, and FIG. 5 is a sectional view illustrating a state of the car door apparatus illustrated in FIG. 4 when the car doors are fully opened. Note that, the external appearance of the car 1 is the same as that illustrated in FIG. 1. Each of the cross sections of FIGS. 4 and 5 corresponds to the cross section taken along the line II-II of FIG. 1.

In this example, the closing-plate supporting portion 9 which is the same as that of Embodiment 1 is fixed onto the inner surface of the cover front-surface portion 6*a*, that is, a surface opposed to the car-door front surface 2*a*. The closing plate 10 is supported by the closing-plate supporting portion 9 so as to be oriented in the opposite direction to that of Embodiment 1. Specifically, the flange portion 10*a* is provided to the end of the closing plate 10, which is on the side opposite to the car doorway 1*a*, so as to restrict the displacement of the closing plate 10 in the door-closing direction relative to the closing-plate supporting portion 9. Moreover, the bent portion 10*b* is provided to the end of the closing plate 10, which is on the car doorway 1*a* side, and is bent to the side opposite to the landing at a right angle.

The closing plate 10 is displaced between the closing position (FIG. 4) at which the closing plate 10 closes the notch portion 6*e* and the retracted position (FIG. 5) to which the closing plate 10 retracts from the closing position in the door-opening direction with the opening/closing of the car doors 2. A closing-plate engagement portion 2*c* which is engaged with the closing plate 10 at the time of the door-closing operation is provided to the end of the car-door front surface 2*a*, which is on the door-pocket side. The closing-plate engagement portion 2*c* projects from the car door front-surface 2*a* toward the landing. Moreover, the closing-plate engagement portion 2*c* is provided continuously over the entire vertical length of the notch portion 6*e*. Further, the buffer 11 such as a rubber is provided to the closing-plate engagement portion 2*c*.

Next, an operation is described. When the car doors 2 are fully closed, the notch portion 6*e* is closed by the closing plate 10 as illustrated in FIG. 4. At this time, the bent portion 10*b* is engaged with the closing-plate engagement portion 2*c* through an intermediation of the buffer 11. Moreover, the gap between the inlet forming portion 6*d* and the car-door rear surface 2*b* is closed by the sound insulating member 8. Further, the gap between the car doors 2 is closed by the abutment of the door-stop rubbers 5 against each other.

At the time of the door-opening operation, the closing plate 10 is pressed by the door clutch portion 4 so as to be guided by the closing-plate supporting portion 9 to slide in the door-opening direction. Specifically, until the door clutch portion 4 abuts against the bend portion 10*b*, the closing plate 10 remains unmoved from the closing position. After the door clutch portion 4 abuts against the bent portion 10*b*, the closing plate 10 slides with the corresponding one of the car doors 2. Then, when the car doors 2 are moved to the position where the car doors 2 are fully opened, the closing plate 10 reaches the retracted position.

At the time of the door-closing operation, the engagement of the closing-plate engagement portion 2*c* with the bent portion 10*b* causes the closing plate 10 to slide in the door-closing direction with the corresponding one of the car doors 2. Specifically, until the closing-plate engagement portion 2*c* is brought into engagement with the bent portion 10*b*, the closing plate 10 remains unmoved from the retracted position. After the closing-plate engagement portion 2*c* is engaged with the bent portion 10*b*, the closing plate 10 slides with the corresponding one of the car doors 2. Then, when the car door 2 is moved to the position where the car doors 2 are fully closed, the closing plate 10 reaches the closing position.

In the car door apparatus for the elevator as described above, the closing plate 10 is supported by the closing-plate supporting portion 9 so as to be slidable along the direction in which the car doors 2 are opened and closed, and therefore slides along with the corresponding one of the car doors 2 only during a part of the opening/closing operation of the car door 2. Thus, the closing plate 10 can be moved between the closing position and the retracted position without being curved. In addition, it is not necessary to enlarge the door-pocket cover 6 outwardly. Accordingly, the closing plate 10 can be prevented from deteriorating due to flexural fatigue, while a width dimension of a hoistway is prevented from being increased.

Moreover, while the car doors 2 are in a fully-closed state, sound insulating properties around the car doors 2 can be ensured. Noise, which is generated in the hoistway when the car 1 is raised and lowered, can be prevented from propagating to the interior of the car 1. Therefore, ride comfort is improved.

Embodiment 3

Figure 6:
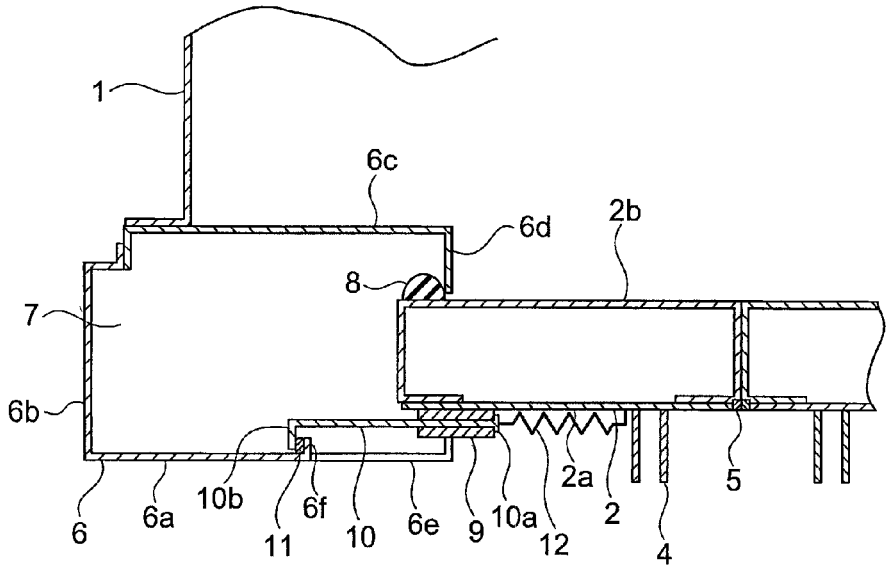
FIG. 6 is a sectional view illustrating the car door apparatus for the elevator according to Embodiment 3 of the present invention.
Figure 7:
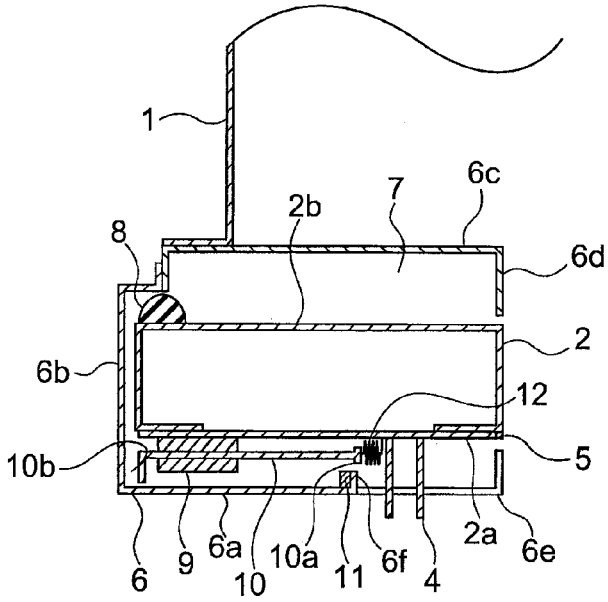
FIG. 7 is a sectional view illustrating a state of the car door apparatus illustrated in FIG. 6 when the car doors are fully opened.

Next, FIG. 6 is a sectional view of the car door apparatus for the elevator according to Embodiment 3 of the present invention, and FIG. 7 is a sectional view illustrating a state of the car door apparatus illustrated in FIG. 6 when the car doors are fully opened. In this example, an extension spring 12 corresponding to biasing means is provided between the end of the closing plate 10, which is on the car doorway 1*a* side, and the vicinity of the door clutch portion 4 provided on the car-door front surface 2*a*. The extension spring 12 biases the closing plate 10 in a direction in which the closing plate 10 is brought into engagement with the closing-plate engagement portion 6*f* (door-closing direction). The remaining structure is the same as that of Embodiment 1.

In the car door apparatus described above, the bent portion 10*b* is pressed against the closing-plate engagement portion 6*f* by a spring force of the extension spring 12 when the car doors 2 are fully closed. Therefore, air-tightness between the bent portion 10*b* and the closing-plate engagement portion 6*f* is enhanced to allow the sound insulating properties to be improved.

Embodiment 4

Figure 8:
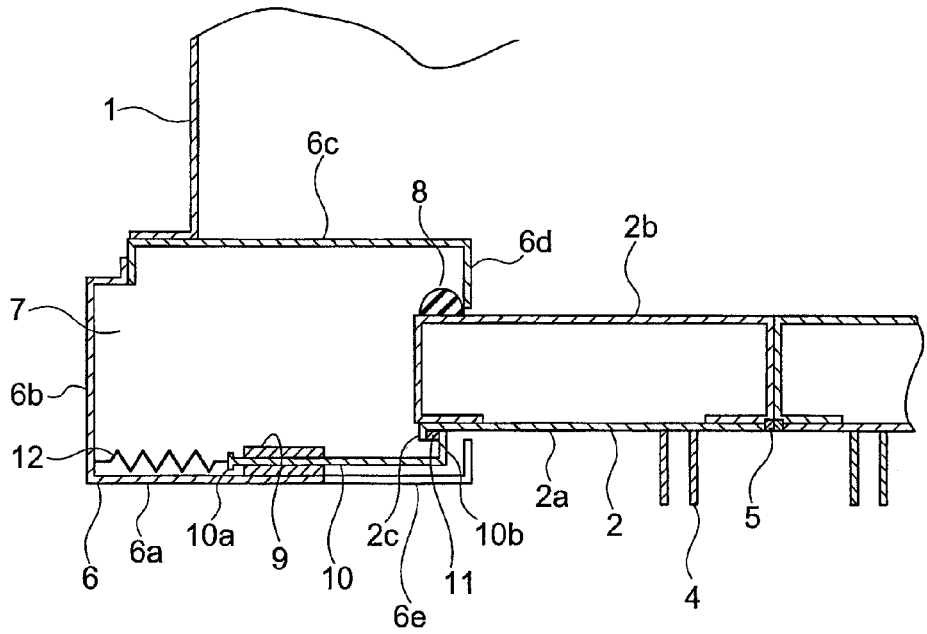
FIG. 8 is a sectional view illustrating the car door apparatus for the elevator according to Embodiment 4 of the present invention.
Figure 9:
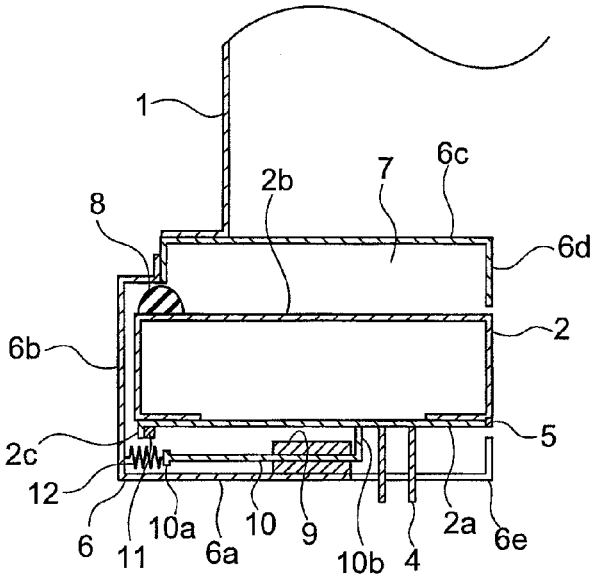
FIG. 9 is a sectional view illustrating a state of the car door apparatus illustrated in FIG. 8 when the car doors are fully opened.

Next, FIG. 8 is a sectional view of the car door apparatus for the elevator according to Embodiment 4 of the present invention, and FIG. 9 is a sectional view illustrating a state of the car door apparatus illustrated in FIG. 8 when the car doors are fully opened. In this example, the extension spring 12 is provided between the end of the closing plate 10, which is on the side opposite to the car doorway 1*a*, and the inner surface of the cover side-surface portion 6*b*. The extension spring 12 biases the closing plate 10 in a direction in which the closing plate 10 is brought into engagement with the closing-plate engagement portion 2*c* (door-opening direction). The remaining structure is the same as that of Embodiment 2.

In the car door apparatus described above, the bent portion 10*b* is pressed against the closing-plate engagement portion 2*c* by a spring force of the extension spring 12 when the car doors 2 are fully closed. Therefore, air-tightness between the bent portion 10*b* and the closing-plate engagement portion 2*c* is enhanced to allow the sound insulating properties to be improved.

Embodiment 5

Figure 10:
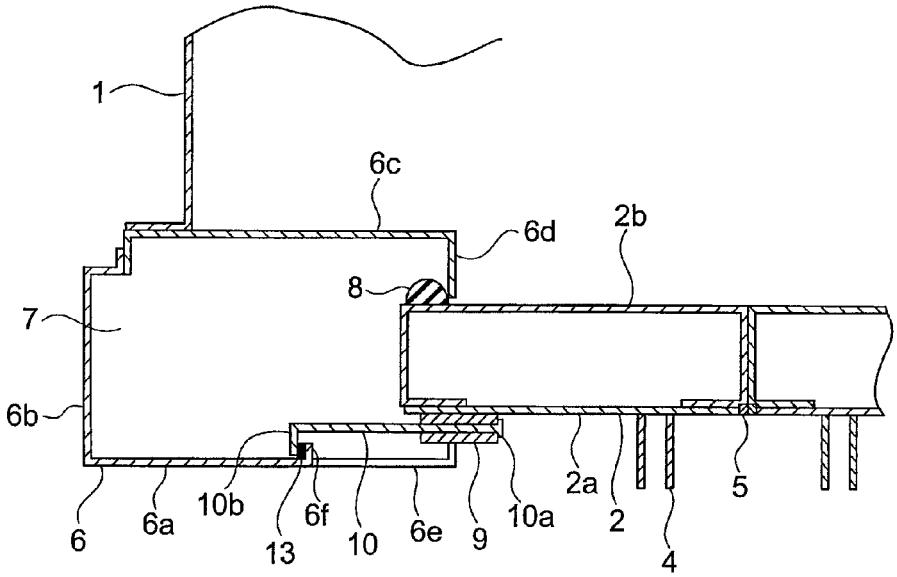
FIG. 10 is a sectional view of the car door apparatus for the elevator according to Embodiment 5 of the present invention.
Figure 11:
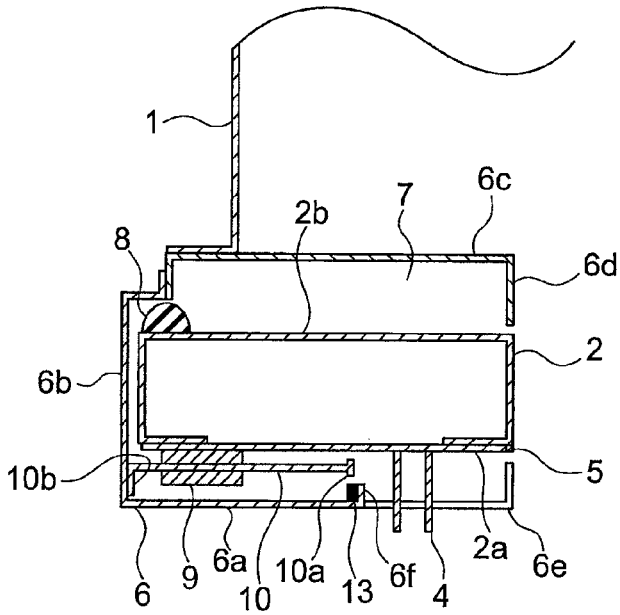
FIG. 11 is a sectional view illustrating a state of the car door apparatus illustrated in FIG. 10 when the car doors are fully opened.

Next, FIG. 10 is a sectional view of the car door apparatus for the elevator according to Embodiment 5 of the present invention, and FIG. 11 is a sectional view illustrating a state of the car door apparatus illustrated in FIG. 10 when the car doors are fully opened. In the drawings, a magnet 13 is provided to the closing-plate engagement portion 6*f*. Moreover, the closing plate 10 is made of a magnetic material. The remaining structure is the same as that of Embodiment 1.

In the car door apparatus described above, the bent portion 10*b* is attracted to the magnet 13 provided to the closing-plate engagement portion 6*f* by a magnetic force when the car doors 2 are fully closed. Therefore, the air-tightness between the bent potion 10*b* and the closing-plate engagement portion 6*f* is increased to allow the sound insulating properties to be improved.

Note that, although the closing plate 10 is entirely made of the magnetic material in Embodiment 5, only a part of the closing plate 10, which abuts against the magnet 13, may be made of the magnetic material.

Moreover, the magnet 13 is provided to the closing-plate engagement portion 6*f* in Embodiment 5. Instead, the magnet 13 may be provided to a portion of the closing plate 10, which abuts against the closing-plate engagement portion 6*f*, that is, to the bent portion 10*b*, whereas the closing-plate engagement portion 6*f* may be made of the magnetic material.

Further, the magnets can also be provided to both the closing-plate engagement portion 6*f* and the bent portion 10*b*. In this case, it is apparent that the opposite magnetic poles are brought into abutment against each other.

Embodiment 6

Figure 12:
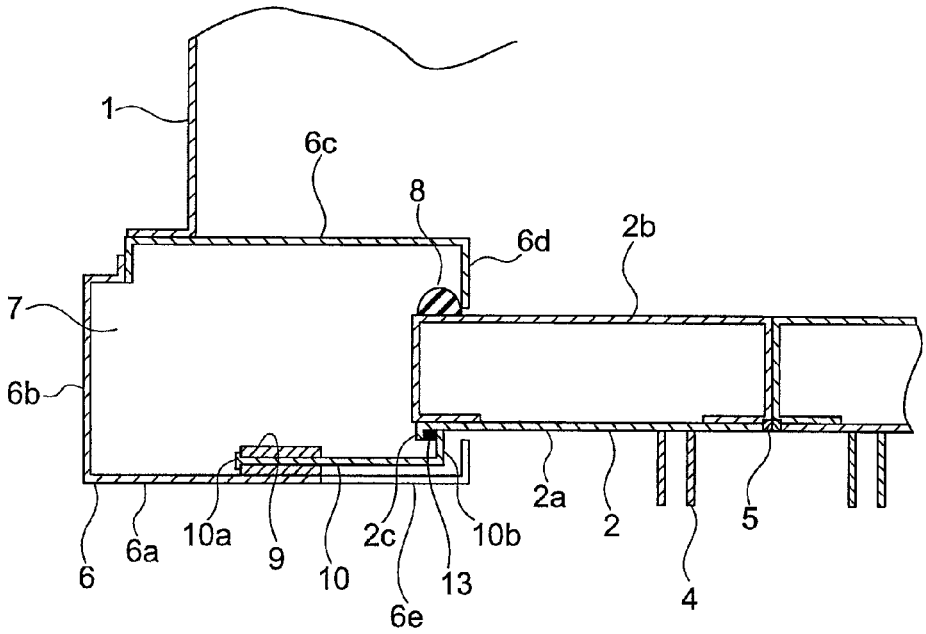
FIG. 12 is a sectional view illustrating the car door apparatus for the elevator according to Embodiment 6 of the present invention.
Figure 13:
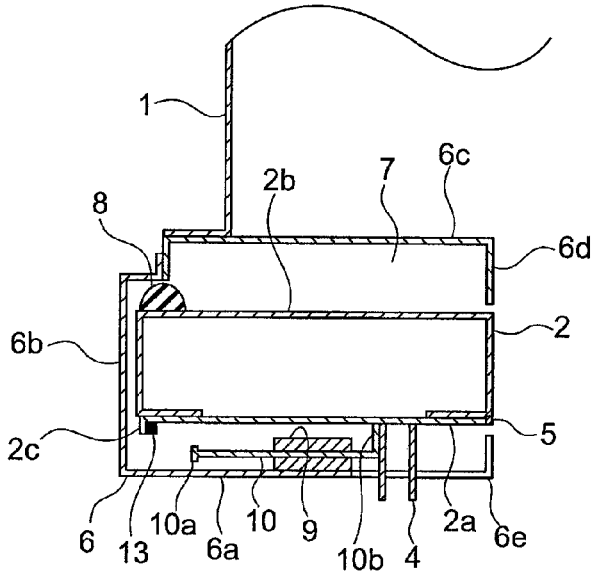
FIG. 13 is a sectional view illustrating a state of the car door apparatus illustrated in FIG. 12 when the car doors are fully opened.

Next, FIG. 12 is a sectional view of the car door apparatus for the elevator according to Embodiment 6 of the present invention, and FIG. 13 is a sectional view illustrating a state of the car door apparatus illustrated in FIG. 12 when the car doors are fully opened. In the drawings, a magnet 13 is provided to the closing-plate engagement portion 2*c*. Moreover, the closing plate 10 is made of a magnetic material. The remaining structure is the same as that of Embodiment 2.

In the car door apparatus described above, the bent portion 10*b* is attracted to the magnet 13 provided to the closing-plate engagement portion 2*c* by a magnetic force when the car doors 2 are fully closed. Therefore, the air-tightness between the bent potion 10*b* and the closing-plate engagement portion 2*c* is increased to allow the sound insulating properties to be improved.

Note that, although the closing plate 10 is entirely made of the magnetic material in Embodiment 6, only a part of the closing plate 10, which abuts against the magnet 13, may be made of the magnetic material.

Moreover, the magnet 13 is provided to the closing-plate engagement portion 2*c* in Embodiment 6. Instead, the magnet 13 may be provided to a portion of the closing plate 10, which abuts against the closing-plate engagement portion 2*c*, that is, to the bent portion 10*b*, whereas the closing-plate engagement portion 2*c* may be made of the magnetic material.

Further, the magnets can also be provided to both the closing-plate engagement portion 2*c* and the bent portion 10*b*. In this case, it is apparent that the opposite magnetic poles are brought into abutment against each other.

The invention claimed is:

1. A car door apparatus for an elevator, comprising:

a car door for opening and closing a car doorway, having a car-door front surface opposed to a landing door;

a door clutch portion provided on the car-door front surface so as to project toward a landing to be brought into engagement with landing equipment;

a door-pocket cover including a cover front-surface portion opposed to the car-door front surface when the car door is fully opened, and a cover side-surface portion extending from the cover front-surface portion to a side opposite to the landing, the cover front-surface portion including a notch portion for allowing the door clutch portion to escape at a time of a door-opening operation; and a closing plate for closing the notch portion when the car door is fully closed, wherein the car-door front surface is provided with a closing-plate supporting portion for supporting the closing plate so that the closing plate is slidable along a direction in which the car door is opened and closed, the door-pocket cover is provided with a closing-plate engagement portion brought into engagement with the closing plate at a time of a door-closing operation to restrict displacement of the closing plate in a door-closing direction relative to the cover front-surface portion, and the closing plate is displaced along with the car door in a door-opening direction to abut against an inner surface of the cover side-surface portion so as to slide in the door-closing direction relative to the car door at the time of the door-opening operation and is displaced along with the car door in the door-closing direction to be brought into engagement with the closing-plate engagement portion so as to slide in the door-opening direction relative to the car door at the time of the door-closing operation.

2. A car door apparatus for an elevator, comprising:

a car door for opening and closing a car doorway, having a car-door front surface opposed to a landing door;

a door clutch portion provided on the car-door front surface so as to project toward a landing to be brought into engagement with landing equipment;

a door-pocket cover including a cover front-surface portion opposed to the car-door front surface when the car door is fully opened, and a cover side-surface portion extending from the cover front-surface portion to a side opposite to the landing, the cover front-surface portion including a notch portion for allowing the door clutch portion to escape at the time of a door-opening operation; and a closing plate for closing the notch portion when the car door is fully closed, wherein a closing-plate supporting portion for supporting the closing plate so that the closing plate is slidable along a direction in which the car door is opened and closed is provided on a surface of the cover front-surface portion, the surface being opposed to the car-door front surface, a closing-plate engagement portion to be brought into engagement with the closing plate at the time of a door-closing operation is provided to an end of the car-door front surface, the end being on a door-pocket side, and the closing plate is pressed by the door clutch portion to slide in a door-opening direction at the time of the door-opening operation and is brought into engagement with the closing-plate engagement portion to slide along with the car door in the door-closing direction at the time of the door-opening operation.

3. The car door apparatus for an elevator, according to claim 1, further comprising biasing means for biasing the closing plate in a direction in which the closing plate is brought into engagement with the closing-plate engagement portion.

4. The car door apparatus for an elevator, according to claim 1, wherein the closing plate is attracted to the closing-plate engagement portion by a magnetic force.

5. The car door apparatus for an elevator, according to claim 2, further comprising biasing means for biasing the closing plate in a direction in which the closing plate is brought into engagement with the closing-plate engagement portion.

6. The car door apparatus for an elevator, according to claim 2, wherein the closing plate is attracted to the closing-plate engagement portion by a magnetic force.

* * * * *